US008225435B2

(12) United States Patent
Kik, Jr. et al.

(10) Patent No.: US 8,225,435 B2
(45) Date of Patent: Jul. 24, 2012

(54) SHOWER BENCH

(75) Inventors: Paul Kik, Jr., Grand Rapids, MI (US); Jim Wadaga, Grand Haven, MI (US)

(73) Assignee: Noble Company, Spring Lake, MI (US)

( * ) Notice: Subject to any disclaimer, the term of this patent is extended or adjusted under 35 U.S.C. 154(b) by 841 days.

(21) Appl. No.: 12/328,227

(22) Filed: Dec. 4, 2008

(65) Prior Publication Data

US 2009/0183306 A1 Jul. 23, 2009

Related U.S. Application Data

(60) Provisional application No. 61/022,638, filed on Jan. 22, 2008.

(51) Int. Cl.
*A47K 3/022* (2006.01)

(52) U.S. Cl. ..... 4/578.1; 4/571.1; 4/574.1; 248/220.1

(58) Field of Classification Search ..... 4/611, 571.1, 4/574.1, 578.1; 52/34–35; 248/220.1, 615, 248/628

See application file for complete search history.

(56) References Cited

U.S. PATENT DOCUMENTS

| | | | | |
|---|---|---|---|---|
| 682,192 | A | 9/1901 | Hazen | |
| 1,286,588 | A | 12/1918 | Goodykoontz | |
| 2,465,635 | A | 3/1949 | Conterio | |
| 2,700,475 | A | 1/1955 | Stalter | |
| 4,535,890 | A * | 8/1985 | Artusi | 206/530 |
| 4,555,082 | A | 11/1985 | Sack et al. | |
| 4,708,310 | A | 11/1987 | Smith | |
| 4,886,236 | A | 12/1989 | Randall | |
| 5,513,575 | A | 5/1996 | Slade | |
| 5,542,218 | A | 8/1996 | Rompel | |
| 5,732,421 | A | 3/1998 | Scherberger | |
| 6,052,845 | A | 4/2000 | Harvey | |
| 6,070,536 | A | 6/2000 | Cinkaj | |
| 6,164,610 | A * | 12/2000 | Santiago | 248/235 |
| 6,301,725 | B1 | 10/2001 | Harvey | |
| 7,673,420 | B2 * | 3/2010 | Madesh | 52/34 |
| 7,987,535 | B1 * | 8/2011 | Tesch | 4/611 |

* cited by examiner

*Primary Examiner* — Gregory Huson
*Assistant Examiner* — Karen L Younkins
(74) *Attorney, Agent, or Firm* — Price Heneveld LLP

(57) ABSTRACT

A shower bench includes an L-shaped first brace with legs attached to vertical shower walls. A bench subassembly includes a cross brace, a foam block, and a T-shaped beam made of cementitious bonding agent that adheres the cross brace to the foam block and also adds strength to a front edge of the foam block. The brace and the block are cut to fit horizontally against the first brace with legs overlapping, such that the braces form a rigid geometric arrangement that supports the block. Ends of the braces are screwed together. The large uniform surfaces of the block are covered with tile and grout. The resulting assembly is extremely rigid and non-flexing, such that cracking of the tile and grout is substantially minimized, even when the bench is loaded up to 400 lbs.

16 Claims, 6 Drawing Sheets

SHOWER BENCH

This application claims benefit under 35 U.S.C. §119(e) of provisional application Ser. No. 61/022,638, filed Jan. 22, 2008, entitled SHOWER BENCH, the entire contents of which are incorporated herein in their entirety.

BACKGROUND

The present invention relates to shower benches attached to and vertically supported by vertical walls in a shower, but that is not supported by a floor of the shower.

There are shower installations that require benches. A common method for construction of a shelf style bench is to construct a frame of wood supported on a floor of the shower, attach plywood or a cementitous backer board to form a structural bench, and then attach a ceramic tile or natural stone bonded to the top and front surfaces for aesthetics and water resistance. However, units constructed using wood framing are subject to expansion, contraction, and warp due to the extreme variation in temperature and humidity found in a shower environment. The wood framing also provides a food source that supports mold growth. In addition, warping causes grout and tile failures that contribute to deflection.

One known shower bench (called Better Bench®) uses a formed sheet metal pan attached to a shower wall corner. The pan is filled with 50-80 lbs. of mortar depending on its size and configuration. The arrangement is manually intensive to install, and further is difficult to correctly install, such that most people cannot do the installation but instead must hire a skilled worker. The bench develops its strength as the mortar cures. Due to the wet shower environment, salts can leach from the mortar and cause staining of the walls and floor. However, this inherently requires significant cure time for the mortar prior to setting the tile or natural stone. Thus, it is expensive, both due to the requirement of using skilled labor, and due to the fact that the skilled person needs to allow the mortar to cure and return to the job to set the tile and grout the bench.

SUMMARY OF THE PRESENT INVENTION

In one aspect of the present invention, a shower bench includes a first brace adapted for attachment to shower walls. A bench subassembly includes a cross brace, a foam block, and bonding agent that adheres the cross brace to the foam block. The brace and the block are cut so that the bench subassembly fits horizontally into the legs of the first brace, such that the cross brace and corner brace combine to form a rigid geometric arrangement that supports the foam block, with the beam of cured bonding agent further adding strength to the overall assembly.

In a narrower aspect, the cured bonding agent also adds structure to a front of the bench by forming a beam-simulating structure.

In a narrower aspect, ends of the braces are fixed securely together, such as by screws. Notably, the screws can be self-tapping if desired.

In a narrower aspect, the foam block includes large flat surfaces, and tile and grout are applied to cover all or a majority of the flat surfaces.

In another aspect of the present invention, a method comprises steps of providing a first brace with legs, and attaching the legs to adjacent shower walls. The method further includes providing a bench subassembly including a cross brace, a geometrically-shaped foam block, and a beam made of cementitious bonding agent that adheres the cross brace to the foam block; the brace and the block being cut to fit horizontally into the legs. The method further includes installing the bench subassembly to the first brace including forming a rigid geometric arrangement with the first brace and cross brace.

In still another aspect of the present invention, a method comprises steps of providing a foam block and a cross brace. The method includes forming channels in the foam block with one of the channels being shaped to matably receive the cross brace; placing cementitious bonding agent in the one channel, and placing the cross brace in the one channel on the cementitious bonding agent and then curing the bonding agent to form a subassembly with the cured bonding agent strengthening an edge of the foam block.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
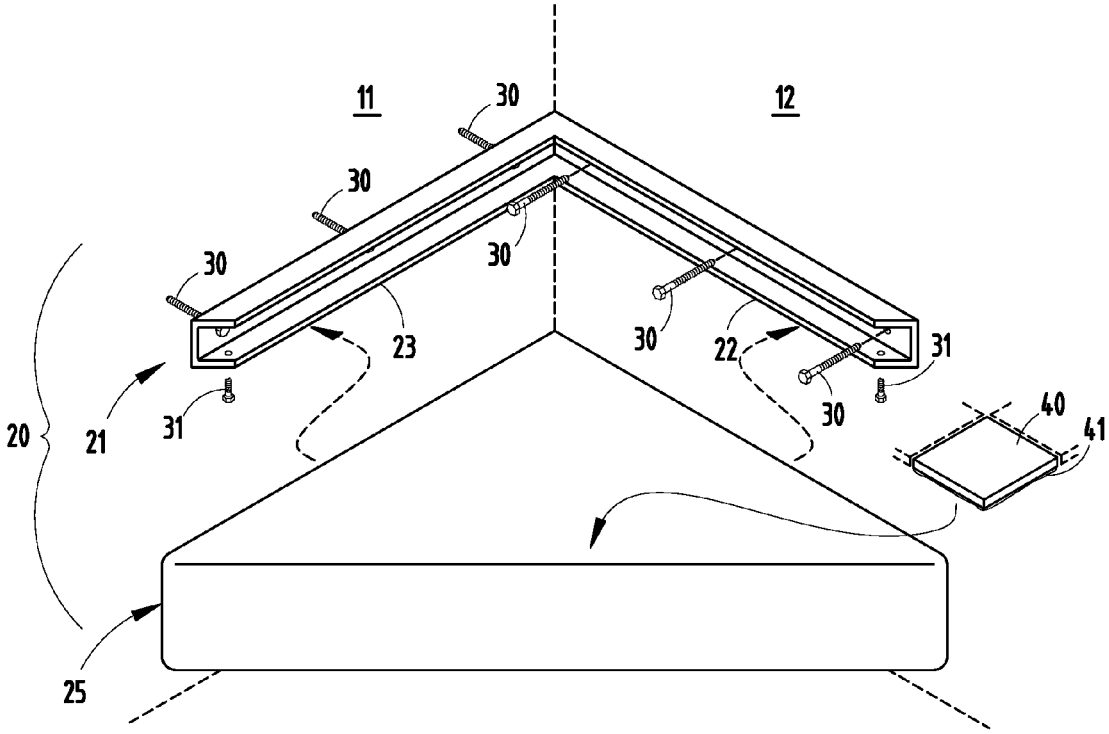
FIG. 1 is a perspective view of an L-shaped corner brace attached to walls in a shower corner, and a foam block subassembly positioned to horizontally engage the corner brace, FIG. 1A being identical to FIG. 1 but showing hidden channels and bonding agent in the foam block subassembly that engage the corner brace.
Figure 2:
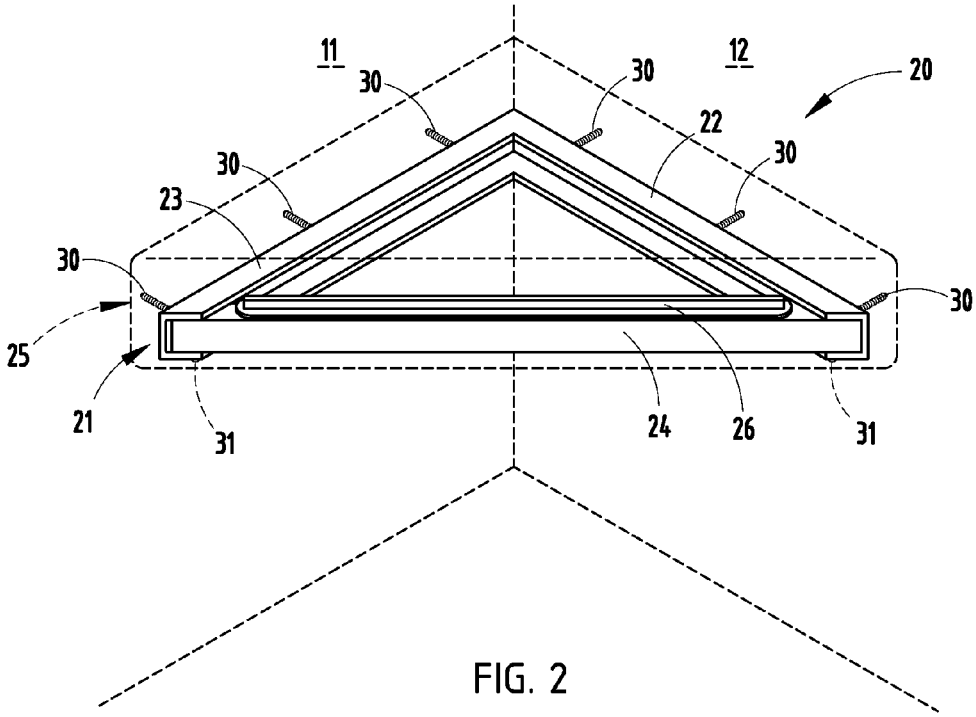
FIG. 2 is a perspective view of the foam block subassembly fit horizontally against the L-shaped corner brace including showing the foam block and bonding agent in dashed lines.

The present shower bench 20 (FIGS. 1-2) includes an L-shaped corner brace 21 (also called a "first brace" or "wall-engaging brace") made of C-channel with legs 22 and 23 attached to shower walls 11 and 12 forming a corner in the illustrated shower, the brace 21 being attached above the shower floor at an optimal height for sitting thereon. A bench piece subassembly includes a cross brace 24, a triangular foam block 25, and a T-shaped beam 26 made of cementitious bonding agent that both adheres the cross brace 24 to the foam block 25 and also forms a beam-like structure that strengthens a front edge of the foam block 25. (Notably, it is contemplated that the present inventive concepts also can be used on other foam block geometric shapes such as a rectangular shape, or a triangular shape with a curved front surface and perpendicular rear surfaces, or square, pentagon, or hexagon shapes.)

The brace 24 is fit into a channel in the block 25 and is positioned to form a subassembly that fits horizontally into the legs 22 and 23 of the corner brace 21. When engaged, the braces 21 and 24 form a rigid triangular arrangement that supports the foam block 25. Ends of the braces 21 and 24 are screwed together, such as with self-tapping screws 31 to form a rigid support structure for the foam block. The large uniform surfaces of the foam block 25 are relatively easy to cover in tile and grout. The resulting assembly is extremely rigid and non-flexing, such that cracking of the tile and grout is not a problem, even when the bench is loaded up to 400 lbs.

Figure 1A:
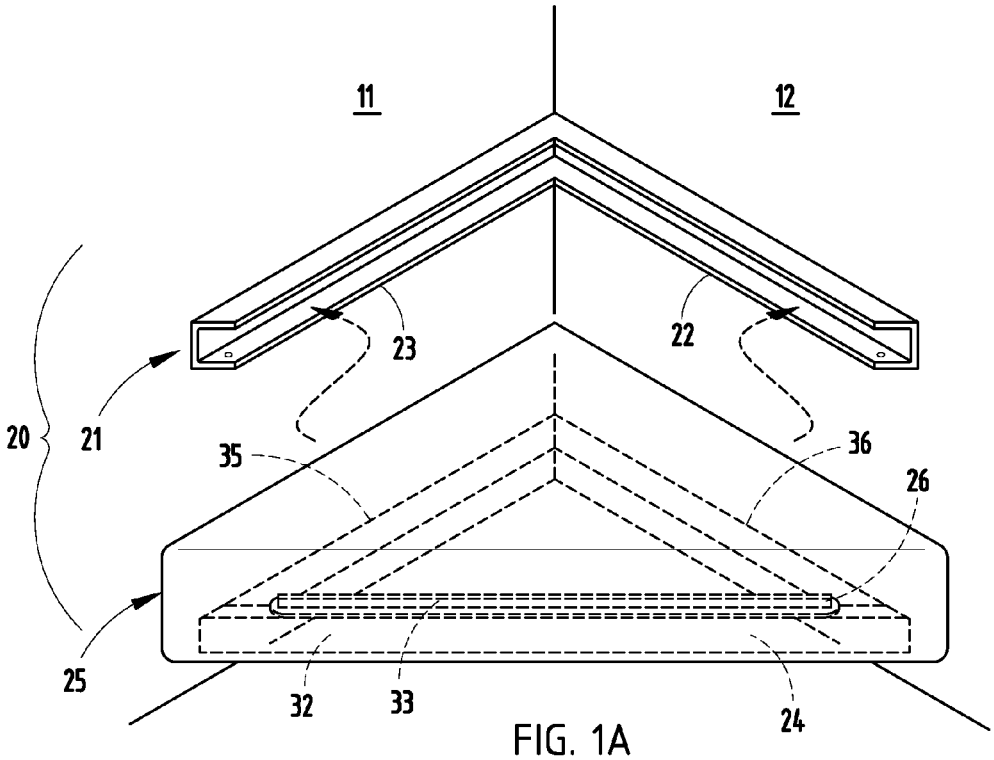

The brace 21 (FIGS. 1-1A) is made of C-shaped metal channel, such as aluminum. Screws 30 attach legs 22 and 23 to the shower walls 11 and 12, such as by engaging anchors placed in the shower walls. The brace 21 is positioned on the walls so that the channel defined by its C-shaped cross section faces outwardly. This installation is considered to be within the level of skill of a typical non-skilled person, such that the installation can be done by unskilled workers at low cost.

Figure 2A:
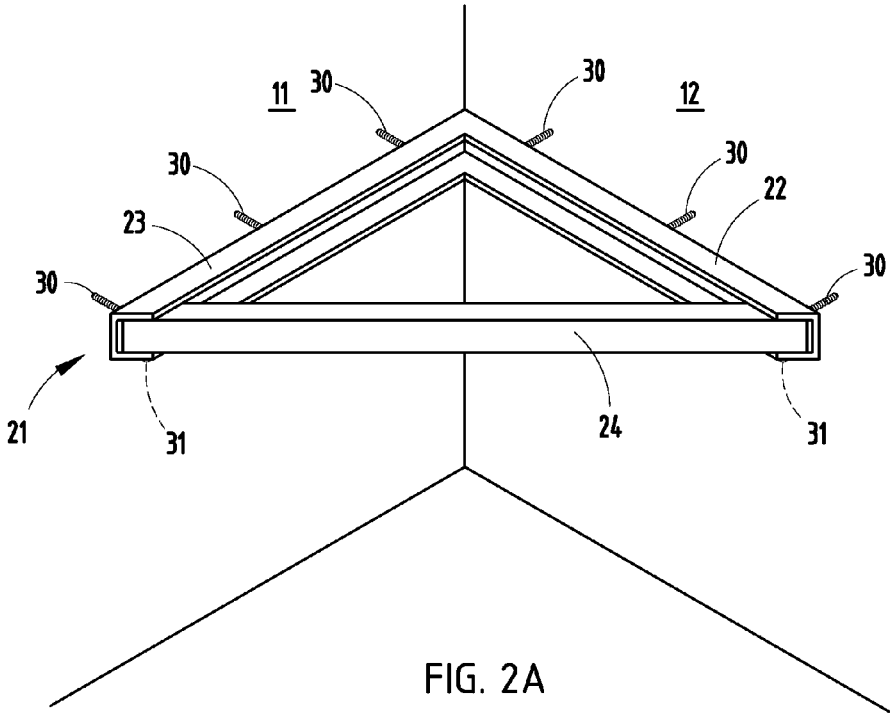
FIG. 2A is identical to FIG. 2 but not showing the foam block nor bonding agent such that interengagement of the cross brack and corner brace is shown.

The brace 24 (shown individually in FIGS. 2-2A, but which is part of the foam block subassembly) is made of tubular metal, such as aluminum. The brace 24 is positioned in the foam block 25 so that its ends fit matably horizontally into the open side of the ends of the legs 22 and 23 of the corner brace 21. Screws 31 securely attach the cross brace 24 to opposing legs of the corner brace 21 to form a rigid triangular bracing arrangement.

Figure 3:
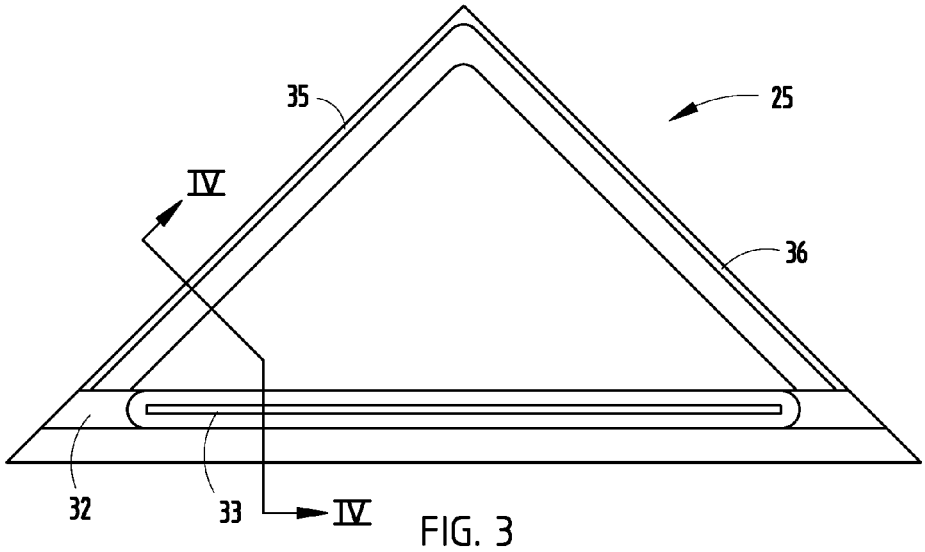
FIG. 3 is a bottom view of the foam block with channels formed therein.
Figure 4:
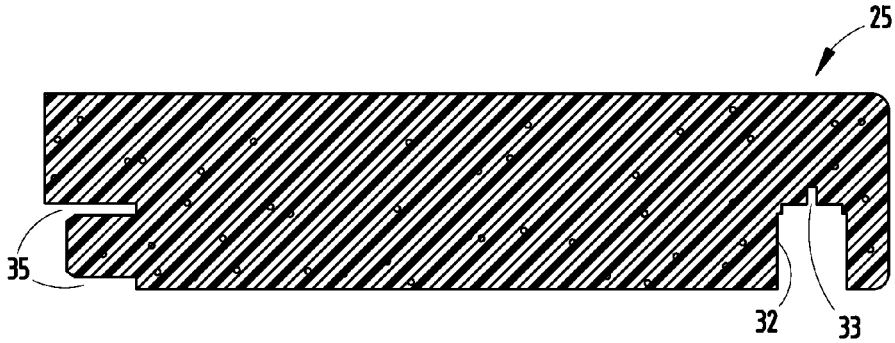
FIG. 4 is a cross section taken along the lines IV-IV in FIG. 3 to thus show shapes of the channels in the foam block.
Figure 5:
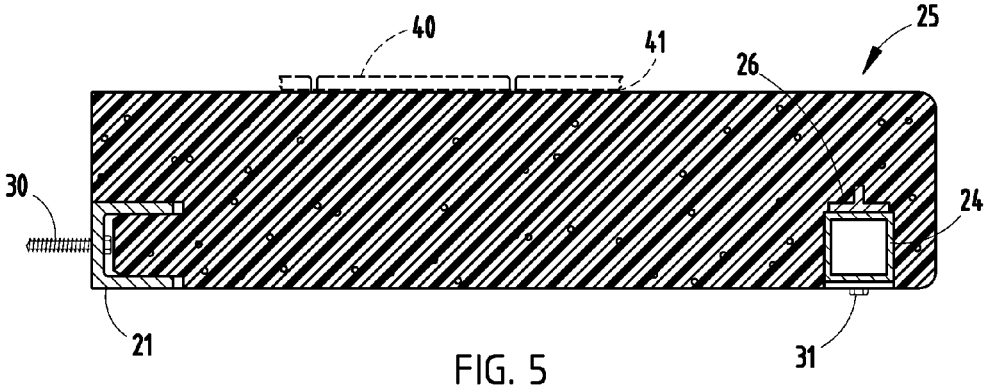
FIG. 5 is a cross section similar to FIG. 4 but showing cross brace bonded to the foam block by the bonding agent, and showing engagement of the corner brace with the foam block.

Foam block 25 (FIGS. 3-4) (preferably slab foam, but potentially poured foam) includes a channel 32 cut into it to receive the brace 24 and a secondary channel 33 cut into the floor of channel 32 to receive cementitious bonding agent 26. The secondary channel 33 is T-shaped and receives cementitious bonding agent 26 for bonding the brace 24 to the block 25. The foam block 25 also includes channels/grooves 35 and 36 for receiving the side flanges of the brace 21. Cementitious bonding agent 26 is poured into the channel 33 and the brace 24 set thereon, and then the cementitious bonding agent 26 is cured. Notably, once cured, the T-shaped cross section of the bonding agent causes the cured bonding agent to form a beam having beam-like strength, such that the cementitious bonding agent 26 itself adds strength along a front edge of the assembly 20 (along with a strength of the cross brace 24).

As thus configured, the block 25 and brace 24 as a subassembled unit can be horizontally slid into mating engagement with the brace 21. Then, the self-tapping screws 31 are put in place, securing the brace 24 to the brace 21 and securing the entire assembly together as a rigid matrix to the walls 11 and 12. The foam block 25 is then aesthetically covered, such as with tiles 40 and grout 41 placed on flat surfaces of the block 25, thus finishing the shower bench 20.

It is contemplated that the bench can be different shapes, heights, and thicknesses, and that the foam can be different densities. Also, a latex-like coating can be put on the foam block to increase adhesion of the tile 40 and grout 41 to the foam block 25. Also, the shape and size of the braces 21 and 24 can be modified for different functional requirements, as well as selection of different cementitious bonding agent 26 for particular functional strength and bonding characteristics, can be made, such as for lower weight applications or different looks.

Figure 6:
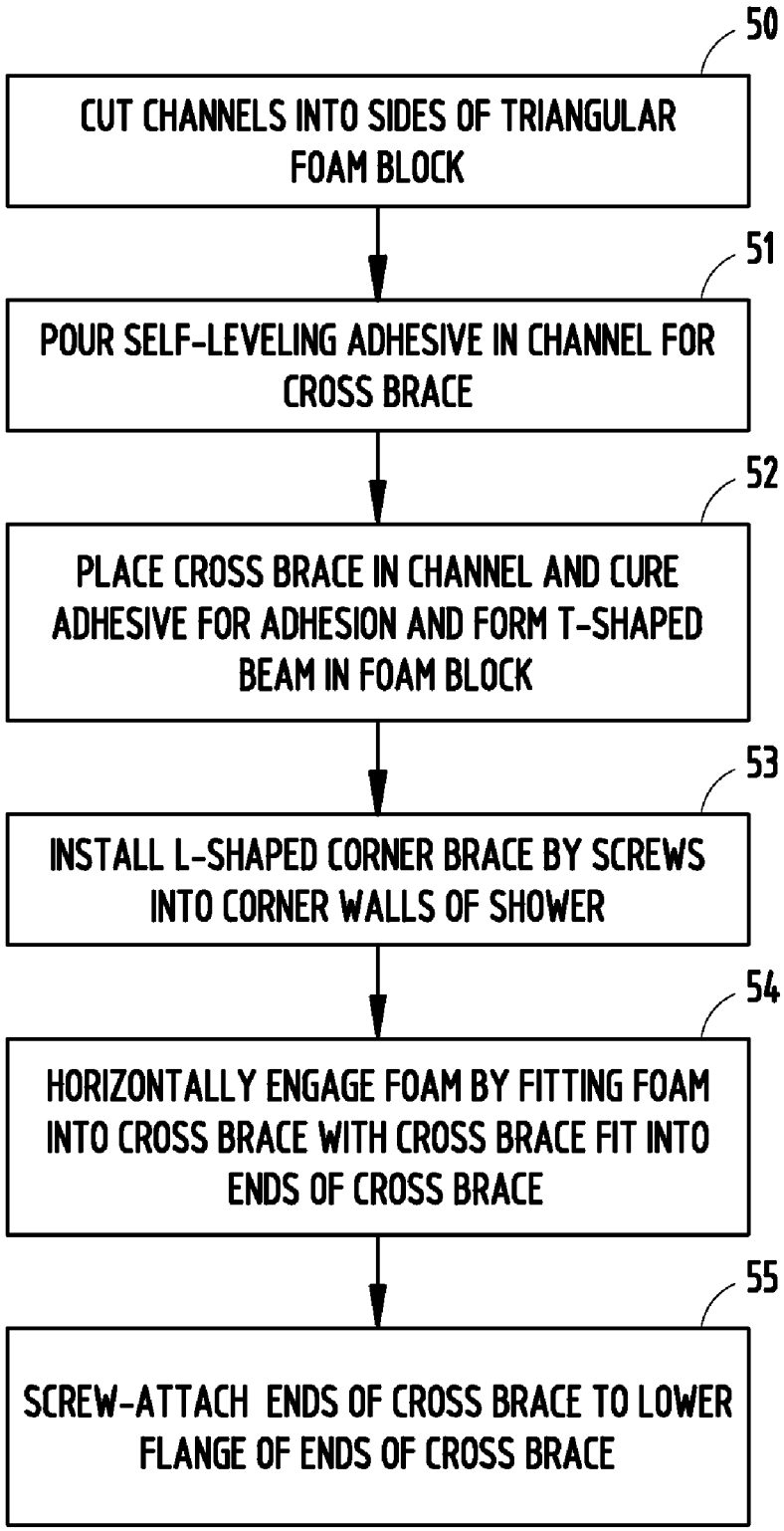
FIG. 6 is a flow chart of the present manufacturing and installation method.
Figure 7:
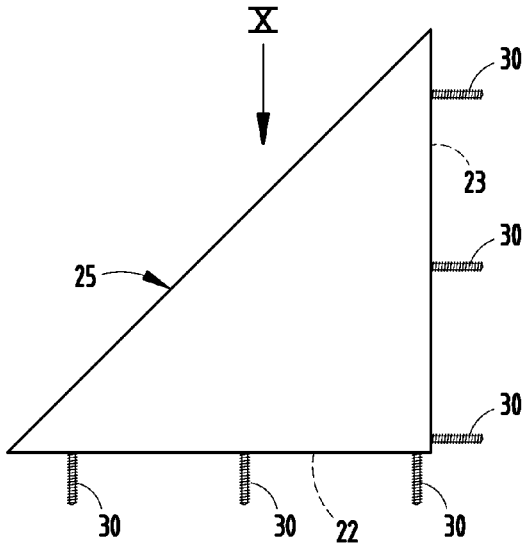
FIG. 7 is a top view of the subassembly engaging the corner brace (and not showing the shower walls)
Figure 9:
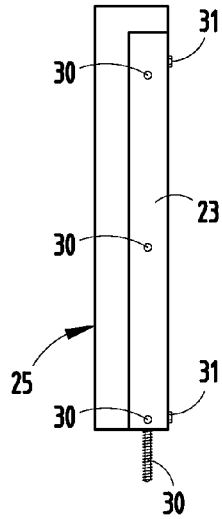
FIGS. 8-10 are orthogonal side views of FIG. 7
Figure 8:
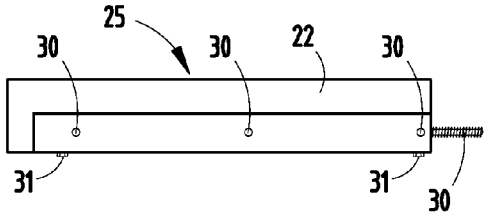
Figure 10:
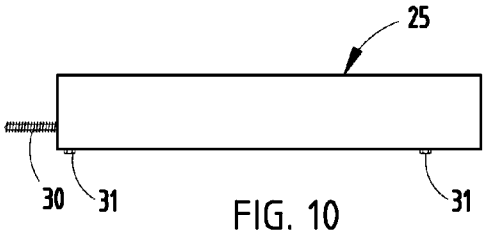
Figure 11:
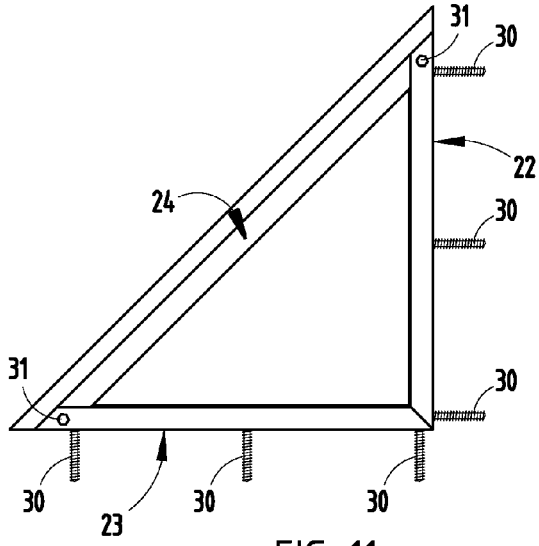
FIG. 11 is a bottom view of FIG. 7.

A method of assembly is also considered part of the invention. The method includes providing the raw product for components and manufacturing the various components, such as cutting channels into the foam block to receive the various braces in step 50 (FIG. 6). Cementitious bonding agent is put into one of the channels for bonding the cross brace 24 to the foam block 25 in step 51, and the cross brace 24 is then placed on the bonding agent in step 52. When the bonding agent cures, it forms a subassembly with the cementitious bonding agent 26 forming a T-shaped beam in the foam block as well as bonding the cross brace 24 to the foam block 25. The corner brace 21 is attached to adjacent shower walls 11 and 12 in a corner of the shower in step 53. The subassembly (i.e., foam block 25, cross brace 24, and bonding agent 26) are then horizontally engaged with the corner brace 21 in step 54. Screws attach the foam block subassembly to the corner brace 21, such that the foam block subassembly is rigidly and fixedly secured to the shower walls. The assembly is aesthetically covered as desired, such as by adhering tiles 40 with grout 41 to flat surfaces of the foam block 25.

A significant criteria of the present assembly is that the foam block/subassembly must not flex any substantial amount, since tile and grout crack even with minimal flexure. The present arrangement works well, and is considered to be very rigid, with any flexure being typically less than L/360 deflection as determined by TCNA guidelines (i.e., Tile Council of North America). Nonetheless, the present assembly is made of relatively low cost components, and provides an installation that most non-skilled persons can do.

FIGS. 7-11 are orthogonal views of the bench 20 (minus the shower walls 11-12).

Figure 12:
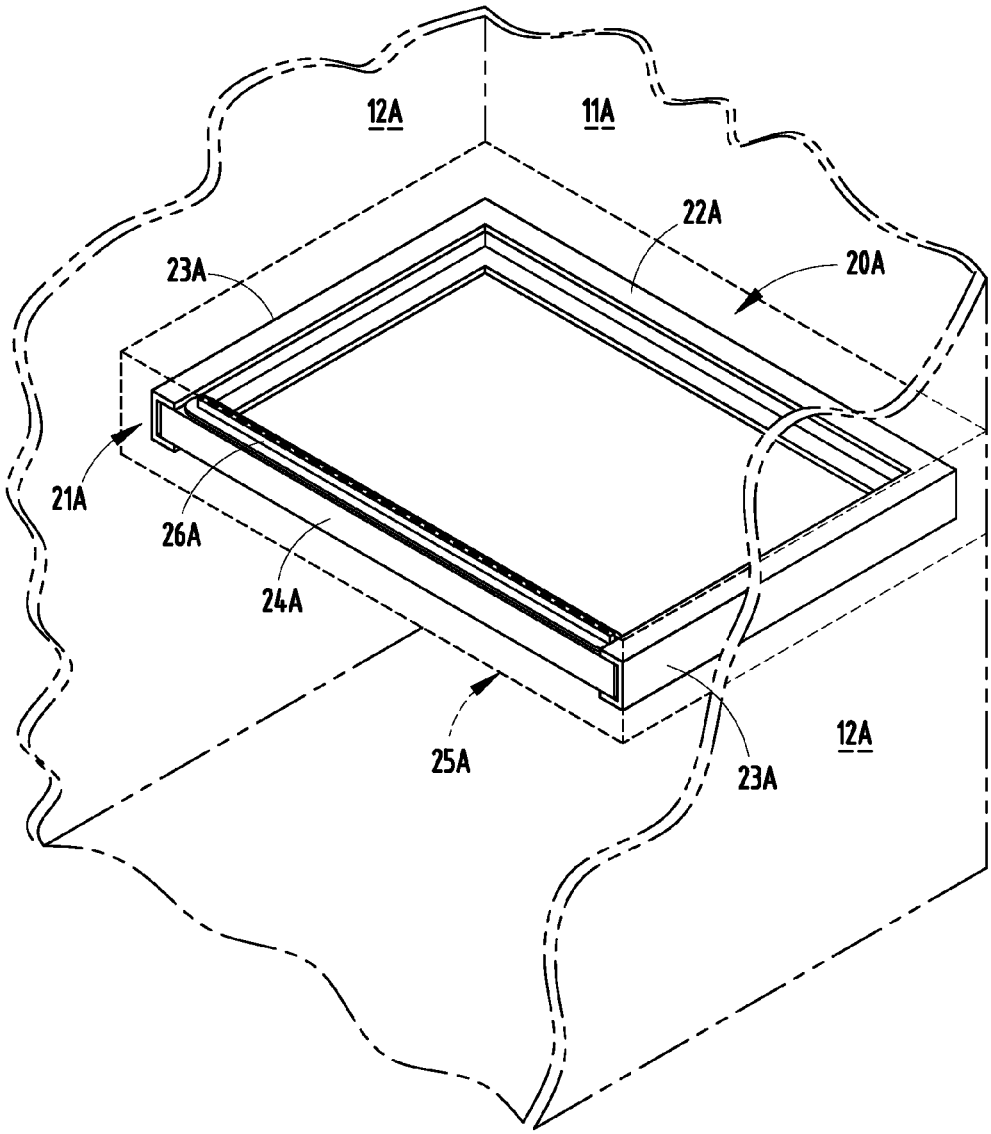
FIG. 12 is a perspective view of an alternative (rectangle) shower bench.

It is contemplated that the bench can be rectangular (see FIG. 12) or other geometric shapes. The bench 20A (FIG. 12) includes channels 22A, 23A, tubular beam 24A, rectangular foam block 25A and bonding agent 26A assembled and configured similar to components 22-26 in FIG. 1.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A method comprising steps of:

providing a foam block;

providing a cross brace;

forming channels in the foam block with one of the channels being shaped to matably receive the cross brace;

placing cementitious bonding agent in the one channel; and placing the cross brace in the one channel on the cementitious bonding agent and curing the bonding agent to form a subassembly with the cured bonding agent combining with the cross brace to form a beam that strengthens an edge of the foam block.

2. The method of claim 1, wherein the foam block defines a triangular shape.

3. The method of claim 2, wherein the cross brace is positioned along a diagonal front long edge of the triangular foam block.

4. The method of claim 1, wherein ends of the cross brace are screwed to ends of the first brace.

5. The method of claim 4, wherein the foam block includes large top and front flat surfaces; and including tile and grout covering a majority of the flat surfaces.

6. The method of claim 1, wherein the cross brace is made from a tubular beam.

7. A shower bench comprising:

a first brace with legs adapted for attachment to shower walls; and a bench subassembly including a cross brace, a foam block, and bonding agent that adheres the cross brace to the foam block and that forms a beam across a front end of the foam block for strength; the brace and the block being shaped to fit horizontally into the legs, such that the cross brace and first brace form a rigid geometric arrangement that supports the foam block.

8. The shower bench defined in claim 7, wherein the legs of the first brace form an L-shape.

9. The shower bench defined in claim 7, wherein the first brace is made from C-channel.

10. The shower bench defined in claim 7, wherein at least one of braces is a C-shaped metal channel.

11. The shower bench defined in claim 7, wherein at least one of braces is tubular.

12. A shower bench adapted for installation into a shower area having adjacent walls forming a corner, comprising:

a first brace with elongated legs connected at one end and adapted to fit into the corner with the legs extending in directions parallel the adjacent walls, the legs defining an open interior space therebetween; and a bench subassembly including an elongated cross brace and a foam block; the block having channels cut into flat surfaces of the block and shaped to horizontally receive and engage the legs, with outer ends of the cross brace being fastened to the outer ends of the legs such that the cross brace and first brace form a rigid geometric arrangement that supports edges of the foam block despite the first brace and cross brace not being under a center of the foam block in the open interior space.

13. The shower bench defined in claim 12, including a bonding agent bonded to the cross brace, and wherein the bonding agent when cured forms a beam shape adding strength to a front edge of the foam block.

14. A shower bench comprising:

a first brace with non-parallel legs adapted for attachment to adjacent shower walls; and a bench subassembly including a cross brace, a foam block, and bonding agent that adheres the cross brace to the foam block; the foam block having flat surfaces with channels cut therein so that the cross brace and the block fit horizontally matingly onto the legs, with the cross brace and first brace forming a rigid geometric arrangement that supports the foam block with a flexibility less than L/360 deflection as determined by TCNA guidelines.

15. The shower bench defined in claim 14, wherein the bonding agent is a cementitious bonding agent.

16. The shower bench defined in claim 14 including a covering of tile and grout attached to and covering at least some surfaces of the foam block.

* * * * *